United States Patent [19]

Labombarde

[11] Patent Number: 4,732,262

[45] Date of Patent: Mar. 22, 1988

[54] APPARATUS FOR SEGREGATING COUNTED SLUGS OF FLATS

[75] Inventor: Raymond A. Labombarde, Nashua, N.H.

[73] Assignee: International Paper Box Machine Co., Inc., Nashua, N.H.

[21] Appl. No.: 9,913

[22] Filed: Feb. 2, 1987

Related U.S. Application Data

[62] Division of Ser. No. 911,304, Sep. 25, 1986.

[51] Int. Cl.[4] ..... B65G 47/31

[52] U.S. Cl. ..... 198/462; 198/422; 198/426; 53/542; 271/150; 271/151; 271/216

[58] Field of Search ..... 198/422, 423, 425, 426, 198/429, 462; 414/113, 330; 53/438, 443, 542; 271/150, 151, 149, 216, 218

[56] References Cited

U.S. PATENT DOCUMENTS

| | | | |
|---|---|---|---|
| 2,392,746 | 1/1946 | Labombarde | 271/216 X |
| 2,691,922 | 10/1954 | Pearce | 53/542 X |
| 3,040,488 | 6/1962 | Winkler et al. | 53/542 X |
| 3,236,162 | 2/1966 | Reist | 198/425 |
| 3,525,097 | 8/1970 | Maulini | 53/542 X |
| 3,562,775 | 2/1971 | Mullins | 53/542 X |
| 3,842,719 | 10/1974 | Fernandez-Rana et al. | 198/423 |
| 4,240,539 | 12/1980 | Klapp | 271/151 X |
| 4,292,785 | 10/1981 | Hammond | 53/542 X |
| 4,531,343 | 7/1985 | Wood | 53/542 X |
| 4,618,136 | 10/1986 | Pessina et al. | 271/150 |

FOREIGN PATENT DOCUMENTS

| | | | |
|---|---|---|---|
| 3541594 | 5/1986 | Fed. Rep. of Germany | 271/216 |

*Primary Examiner*—Robert J. Spar
*Assistant Examiner*—Lyle K. Kimms
*Attorney, Agent, or Firm*—Pearson & Pearson

[57] ABSTRACT

An apparatus for handling a plurality of flat, collapsed, folded paper boxes which have been produced on a high speed, folder-gluer, delivered in shingled formation onto the advancing apron of a stacker, counted into slugs of about fifty each and must be packed into cases for shipment. To enable an operator to grasp individual and successive lifts of the flats between her hands and remove them for packing, the apparatus includes a secondary apron traveling at less speed than the stacker apron to raise the shingled flats upstanding on edge, hold down belts to prevent misalignment and a transversely movable segregation rod mounted on a carriage movable horizontally alongside the path of the flats. The carriage has one-way clutch rollers so that the rod will hold back the leading flat but the carriage will roll freely back to the next slug. Speed reduction mechanism may be used to advance the carriage at less speed than the apron to compress the line of flats when edge stacking is desirable or necesary.

4 Claims, 10 Drawing Figures

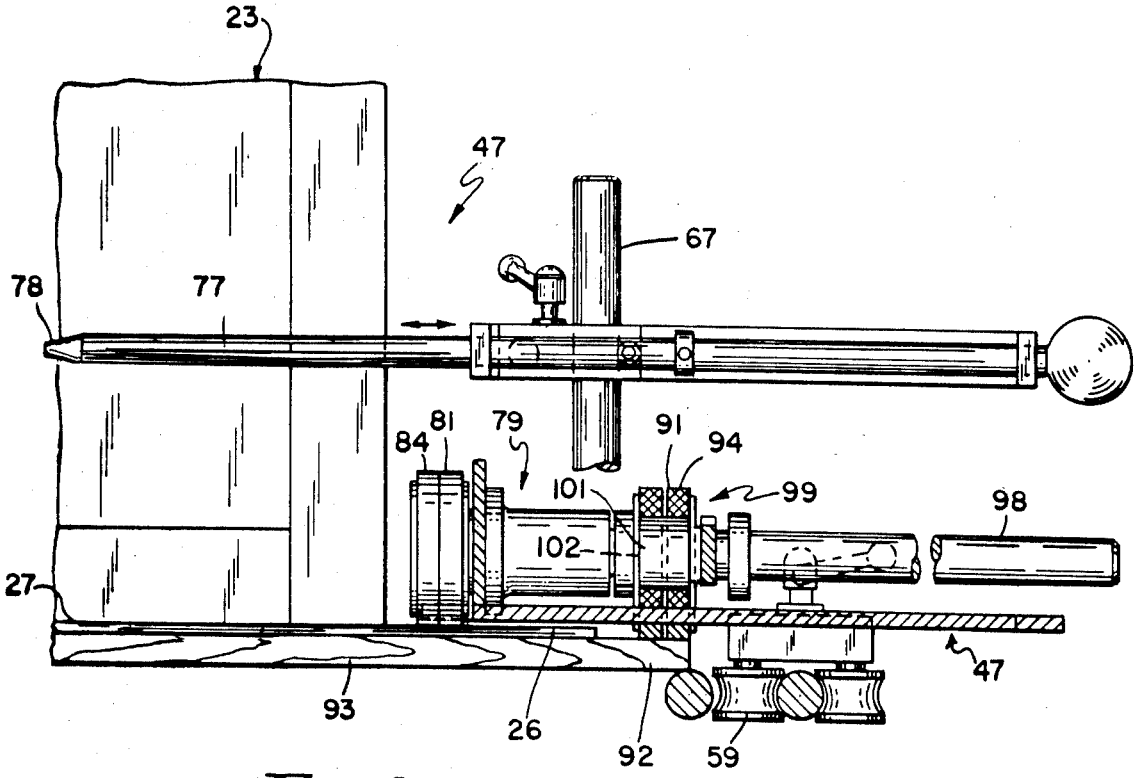
*Fig. 6.*
*Fig. 7.*
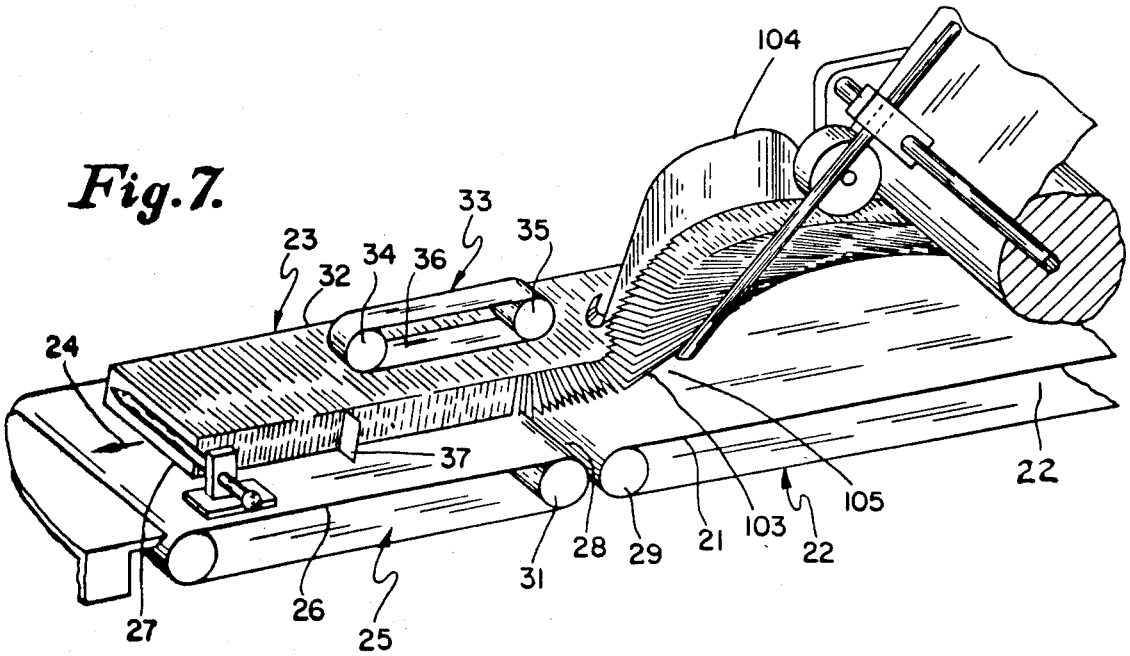

*Fig. 8.*
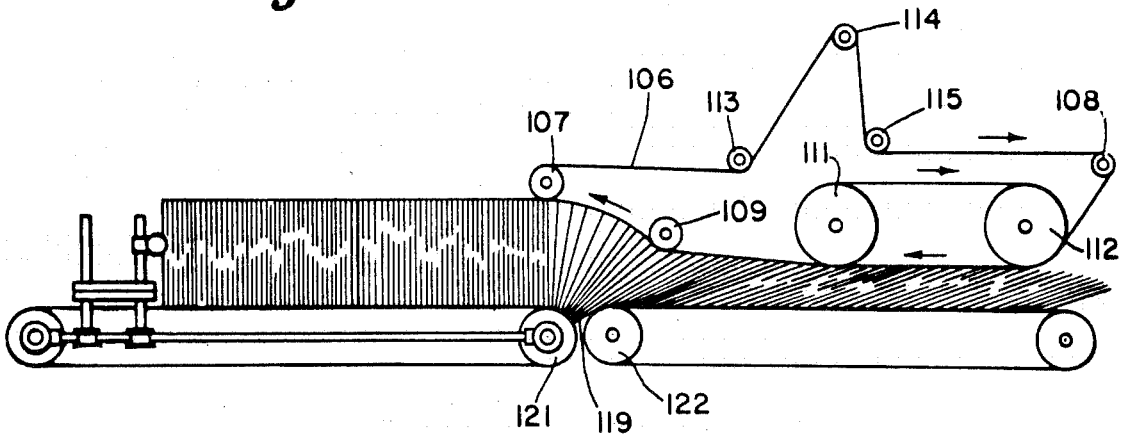
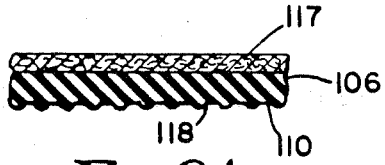
*Fig. 8A.*
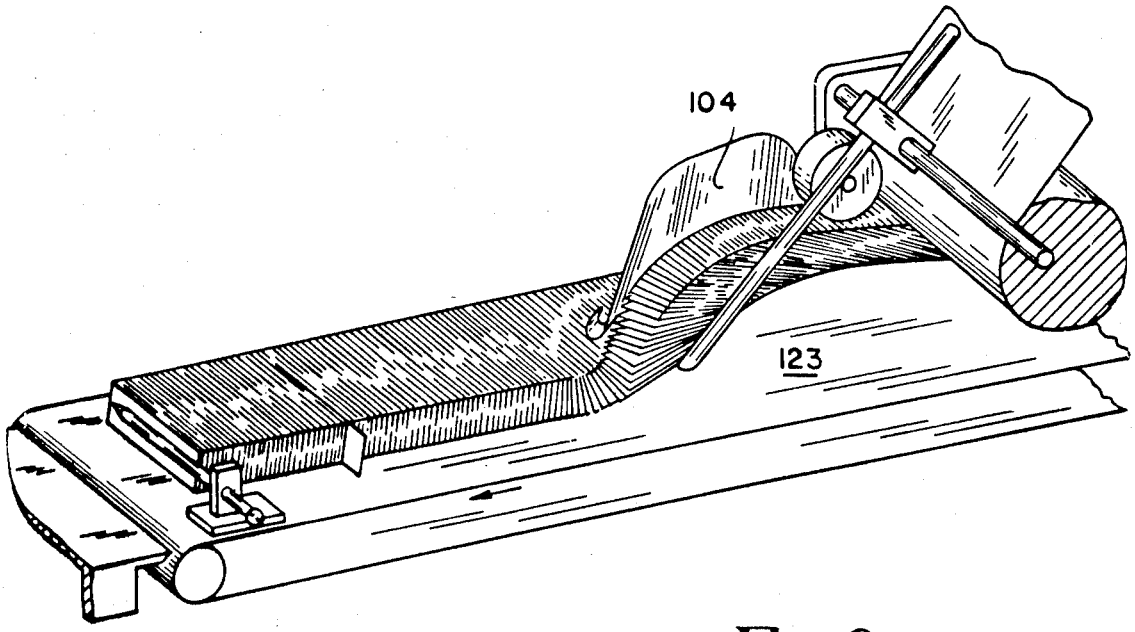
*Fig. 9.*

APPARATUS FOR SEGREGATING COUNTED SLUGS OF FLATS

RELATED APPLICATION

This application is a division of my continuation application Ser. No. 911,304 filed Sept. 25, 1986 entitled Apparatus and Method For Segregating Counted Slugs of Flats.

BACKGROUND OF THE INVENTION

In the folding paper box machine art, folder-gluers are well known to produce flat folded boxes, called "flats" herein, at high speed from flat blanks, by folding and gluing the flaps, tabs and panels thereof and delivering the adhered, collapsed flats to the upper stretch of the endless apron of a stacker. At the exit end of the stacker, it has been the custom for several employees to seek to keep up with the production of the folder-gluer by repeatedly manually removing successive individual "packets" or "lifts" and carrying them over to empty packing cases for deposit one layer, or several layers, to the case. When the flats are shingled and recumbent, with, for example, each fiftieth flat counted and projecting slightly from the line of flats, it will be understood that the operator must place the hand under the flat at the point she believes she can easily carry, raise the flats to upstand on lower edge, compress the lift and try to bodily transport it to an empty case without dropping it on the floor. This continual manual lifting is not only arduous, but if a lift is dropped the stacker continues delivering flats until the entire line may have to be stopped.

In U.S. Pat. No. 3,811,549 to Pressig of May 21, 1974 an apparatus for handling collapsed boxes is disclosed in which a sled and skates with a brake is located in front of the leading box to advance therewith up to a fixed barrier and the segregation element is a plate poised above the path to descend downwardly across the entire path of the flats.

With the fixed stop of this device covering the entire leading flat and the segregation element covering the entire trailing flat, it would be difficult for an operator to grasp the packet, lift or slug between her hands and slide it further along the path. An unillustrated ram is apparently intended to move the captive packet sidewise of the path.

SUMMARY OF THIS INVENTION

This invention is directed to an apparatus and method for handling flats, which will enable a single operator to move from a case packer to the stacker, grasp a slug of counted flats between her hands, slide the slug in the direction of advance of the flats onto a transfer table and into an empty case, and return to grasp the next successive counted slug and repeat the cycle as in U.S. patent application, Ser. No. 583,640 filed Feb. 27, 1984.

To accomplish this efficient operation, a secondary apron is provided in extension of the primary stacker apron and traveling at a slower speed so that the recumbent shingled flats are gradually raised to upstanding position on their lower edges. Preferably, a hold down belt and hold down roll contacts the upper edges of the flats as their upper edges rise upwardly to maintain alignment.

Alongside the secondary apron is a guide in the form of a straight horizontal rod, parallel to the path of the flats, there being a carriage movable forwardly and rearwardly thereon by the contact of grooved rollers. Posts upstanding from the side carriage support a bracket which in turn supports a push rod, movable horizontally into, and out of, the path of the leading flat in the leading counted slug to engage it about mid-height. A one-way clutch in a roller which engages the secondary apron enables the carriage and rod to be advanced by the flats and apron, while prevented from forward fall by the push rod.

When the operator places her left hand on the leading flat she can withdraw the push rod, move the carriage in the direction of retraction, reinsert it in a predetermined position such as in front of the next successive counted slug and insert her right hand with the rod to grasp and slide the slug forwardly off the apron.

In another embodiment the roller in contact with the apron is in driving contact with a second roller in contact with the horizontal stacker platform through a one-way clutch and a speed reduction mechanism or drive train. Thus, the carriage advances at a predetermined speed such as one-third the speed of the apron to compress the flats after they have been edge stacked from longitudinal to lateral.

DESCRIPTION OF THE DRAWING

FIG. 6 is a view similar to FIG. 3 of the embodiment shown in FIG. 4;

FIG. 7 is a diagramatic perspective view on a reduced scale showing the secondary apron, hold down means, carriage and rod of the invention;

FIG. 8 is a side elevation view;

FIG. 8A is a side elevation view of the belt;

FIG. 9 is a diagramatic perspective view similar to FIG. 7 showing the continuous stacker apron.

DESCRIPTION OF A PREFERRED EMBODIMENT

Figure 1:
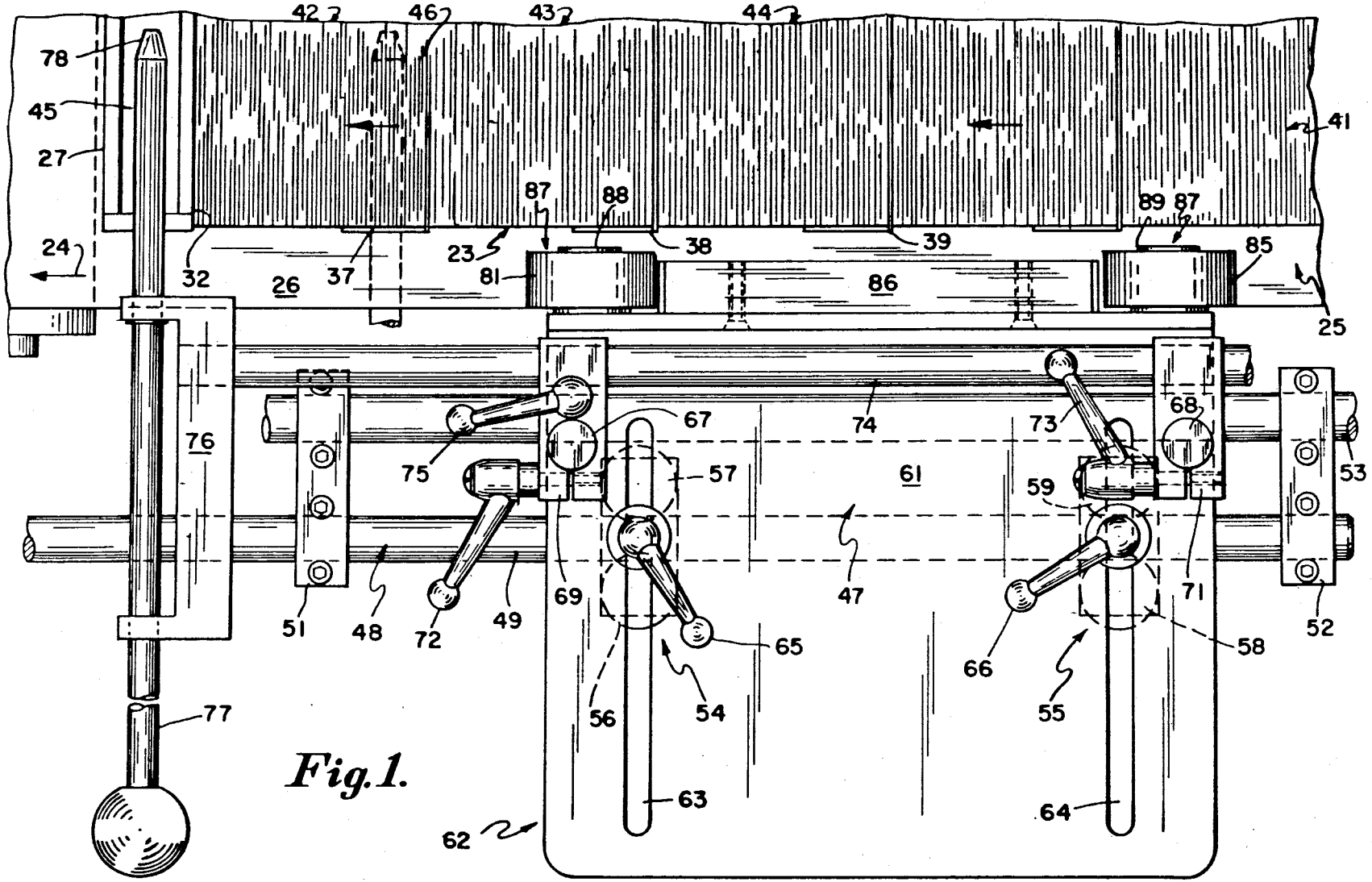
FIG. 1 is a top plan view of the carriage of the invention alongside a secondary stacker apron.

As best shown in FIG. 7, the primary apron 21, of the stacker 22, receives the folded and glued collapsed boxes of trays, such as 23, called "flats" herein, from the folder-gluer, not shown, and advances them in straight line, shingled formation, along the horizontal path 24. In this invention, a secondary stacker 25, is provided with a secondary stacker apron 26, in straight line extension of apron 21, along path 24, the apron 25, being driven by the drive of apron 21, not shown, at a speed less than the predetermined speed of the primary apron 21.

As the lower edge 27 of each successive individual flat 23, drops into the apron nip 28, formed between end roll 29, of apron 21, and entrance roll 31 of apron 25, to encounter the slower moving secondary apron 26, the upper edge 32 of each flat 23, rises in an arc as shown until the flat is upstanding on its lower edge 27.

Preferably, a hold down belt 33, trained around hold down rolls 34, and 35, is provided to exert a downward force on the upper edges 32, of each flat 23, and maintain them in alignment while holding them down. The hold down belt is driven by the drive of apron 21, in a well known manner, and its lower stretch 36, advances at a greater speed than the predetermined speed of the apron 21, to assist in frictionally raising the flats to upstanding, edge supported position.

The conventional folder-gluer includes mechanism which automatically kicks out every fiftieth flat, such as at 37, 38, and 39, laterally sidewise from the shingled line 41 of flats to provide a visual count of individual and successive slugs of flats, each precounted to fit in a packing case when slightly compressed lengthwise. Each individual and successive slug 42, 43 or 44 may be precounted into any number of flats 23, desired, the number fifty being selected herein for convenience of description, it being understood that each run of flats may be as small as folded toothbrush boxes to as large as game boxes.

The size and overlaps of such boxes make considerable difference in the ability of an operator to carry a "lift" thereof without dropping the lift on the floor so that in the prior art several trips and lifts may be required to constitute a single counted slug forming a single layer in a packing case.

In this invention, however, the slug is slidably supported all the way to the packing case so that an operator can grasp the leading flat 45 with the left hand, the trailing flat 46, of the endmost counted slug with the right hand and slide it forwardly along the horizontal path 24, and into the case, as an integral unit with no danger of dropping the slug.

The count divider apparatus 47, of the invention includes the guide means 48, which extends alongside the secondary stacker apron 26, in parallelism with the horizontal path 24, of the line 41 of flats 23, advancing along the path on the apron. Preferably, guide means 48, is an elongated guide or rod 49 attached at each opposite end by clamp blocks such as 51 and 52, to an existing take up piece 53, of the secondary stacker 25, to extend parallel thereto at a spaced distance laterally therefrom.

The rod 49, thus forms a track for two pairs 54 and 55, of grooved track rolls 56, 57, 58, and 59, mounted under the horizontal elongated plate 61, of the carriage, or side car 62, so that the carriage 62 will move horizontally along the guide 49, in parallelism with path 24.

As best shown in FIG. 1, the carriage plate 61, is provided with a pair of laterally extending, longitudinally spaced apart slots 63 and 64, for clamps 65 and 66, so that the plate 61, can be moved laterally to desired locations relative to apron 26 to accommodate flats of various dimensions while still being guided on rod 49.

A pair of longitudinally spaced apart, upstanding posts 67 and 68 are provided on elongated plate 61, each having a split clamp 69 or 71 thereon, tightenable by a handle 72 or 73, for adjustment at a preferred height above plate 61, which is usually about mid-height of the upstanding leading flat 45. The split clamps 69 and 71 support the longitudinally extending member 74, tightenable therein by clamp handle 75, and carrying the yoke, or bracket 76, for laterally slidable or pivotable push rod or member 77, with its pointed terminal end 78. The push rod 77 is a segregation element, mounted on carriage 62, to move transversely and horizontally in and out of path 24, and normally extending into the path in front of the leading flat 45, in each successive, individual slug at about mid-height to support the flats in upstanding position while not interfering with manual grasping of the slug.

Roller means 79, is provided on carriage 62, in the form of at least one roller 81, journalled at 82, to an integral inner wall 83, upstanding from plate 61, and having a friction face 84, in rolling contact with secondary apron 26. Preferably, a second roller 85, is provided also similar to roller 81. The face 84, is preferably of rubber and preferably a weight 86, is provided to assure a firm contact of roller to apron.

One-way clutch means 87, forms part of roller means 79, and includes at least one one-way clutch 88, built-in to roller 81, and preferably a similar one-way clutch 89, built-in to roller 85, (FIG. 1). The one-way clutch means 87, permits the leading flat 45, to bear against the push rod 77, without advancing the rod, or carriage 62, relative to the apron 26, thereby maintaining the leading slug 42, upright ready for grasping by the operator. However, when the operator places the left hand on the leading flat, the push rod can be retracted horizontally, the carriage will roll freely in the opposite of the direction of the apron toward the next successive slug, and the push rod can have its point inserted at the fifty first flat to hold it upright while the operator slides the endmost slug forwardly along path 24, and into a packing case. Thus, the one-way clutches permit the carriage to retract freely on the apron, but prevents advance of the carriage on the apron.

Figure 2:
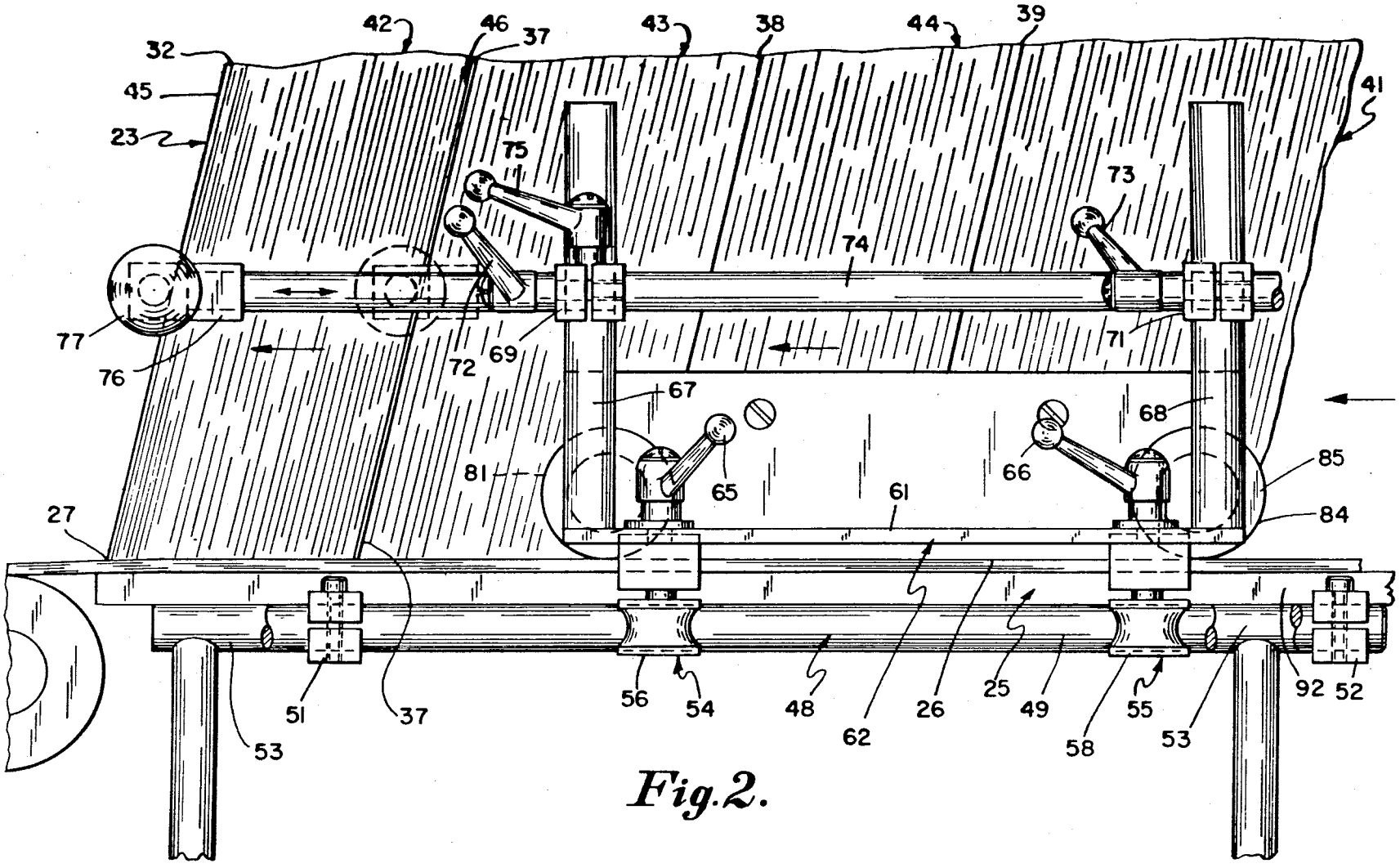
FIG. 2 is a side elevation thereof.
Figure 3:
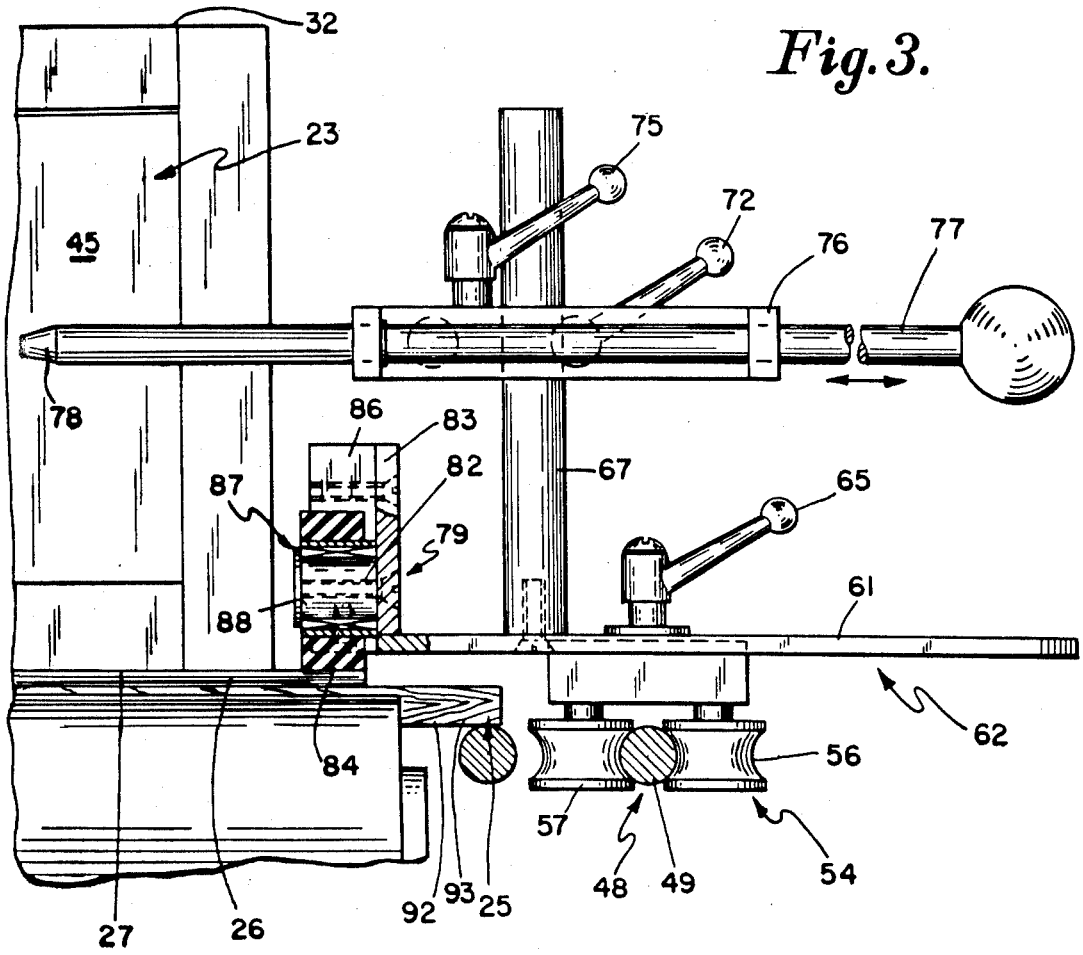
FIG. 3 is an end elevation from the front thereof with the roller in half section.
Figure 4:
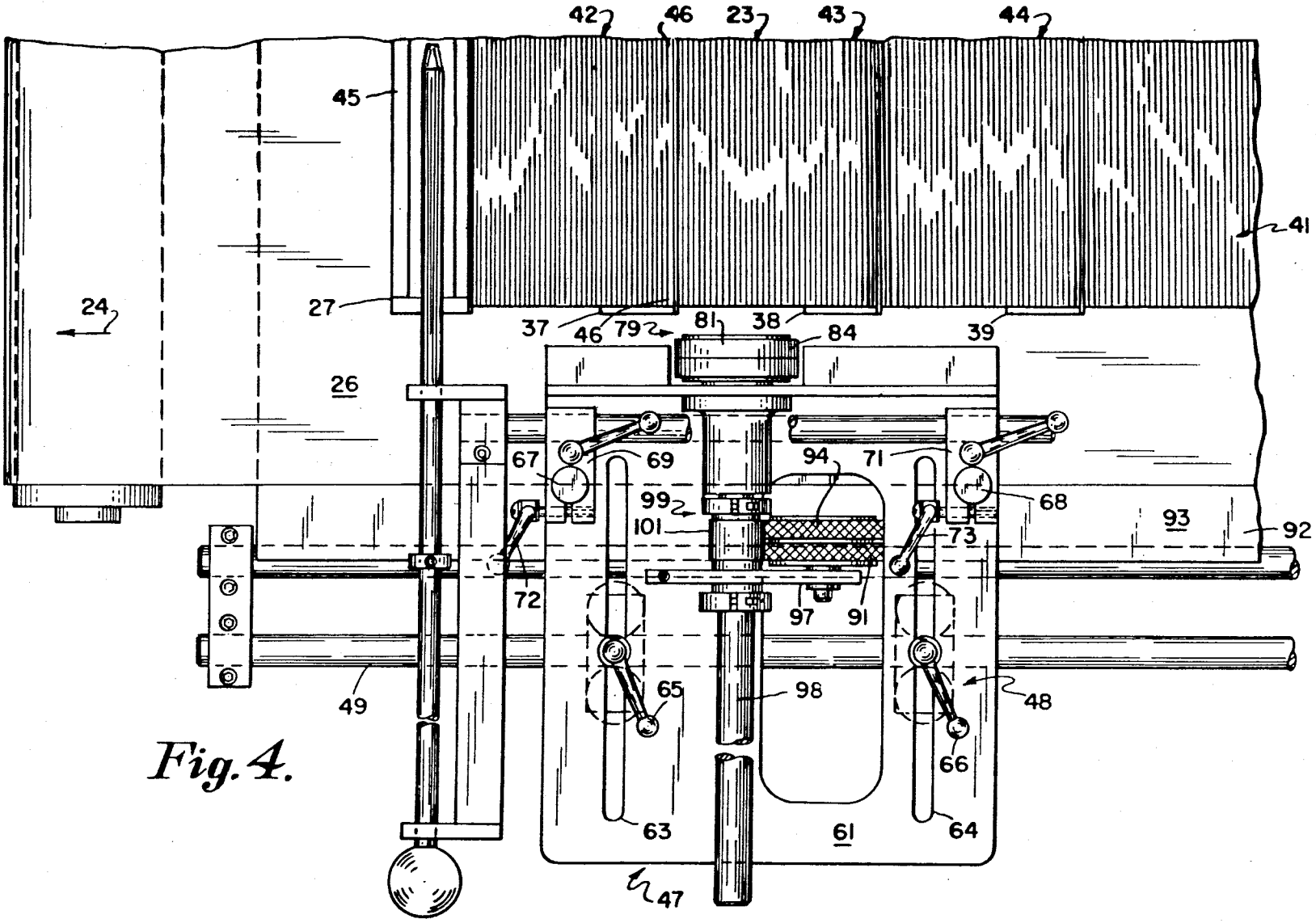
FIG. 4 is a view similar to FIG. 1 of another embodiment.
Figure 5:
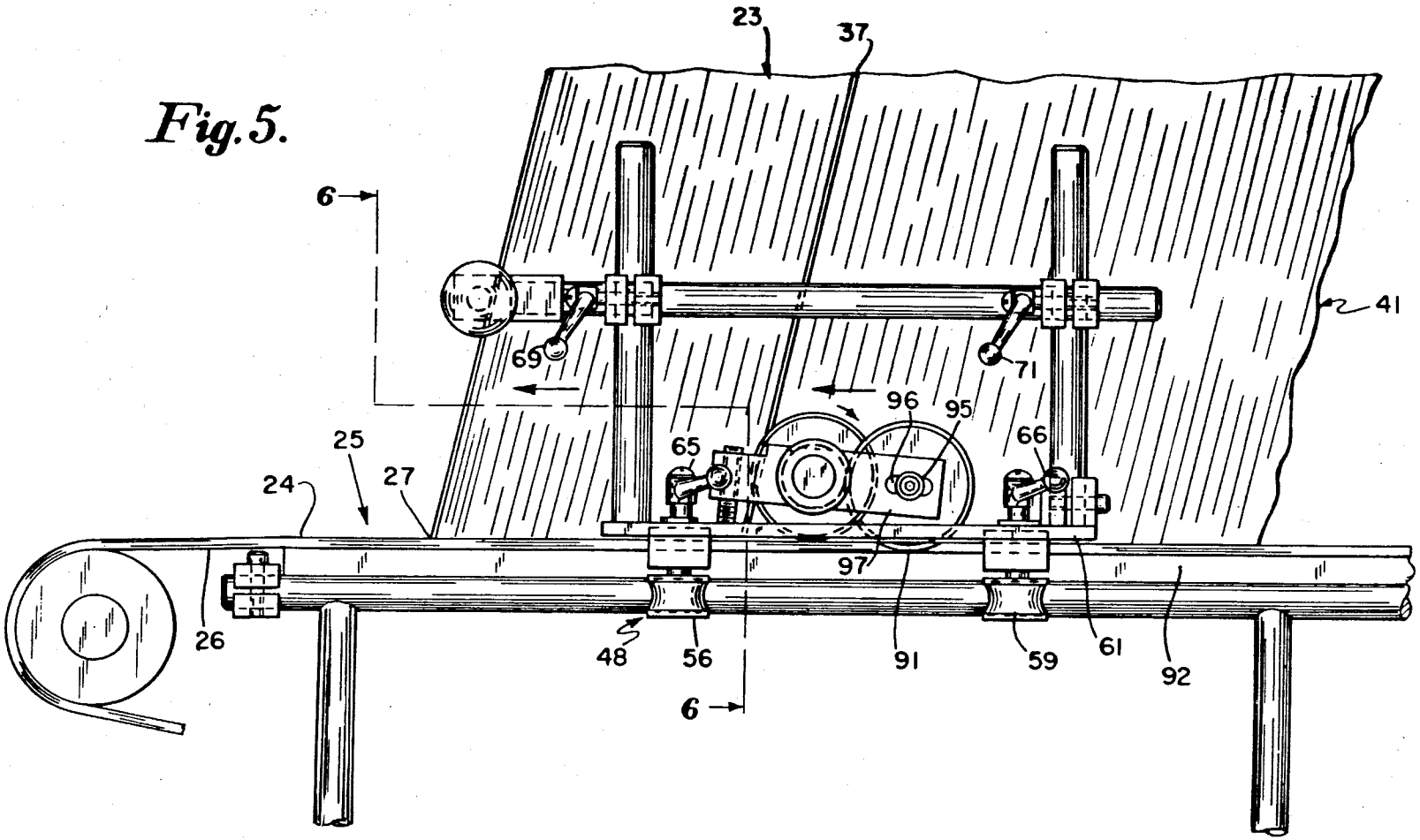
FIG. 5 is a view similar to FIG. 2 of the embodiment shown in FIG. 4.

The embodiment of the invention shown in FIGS. 4, 5, and 6 is similar to the preferred embodiment of FIGS. 1, 2 and 3, except that the roller means 79 includes a second roller 91, in rolling contact with the horizontal, elongated, portion 92, of the stacker platform 93, which extends under the secondary apron 26, for supporting the apron against sag. The second roller 91, has a friction face 94, and is journalled at 95, in a longitudinally extending slot 96, in a lever 97, pivoted on a laterally extending shaft 98. The friction face 84 of roller 81, is in rolling contact with secondary apron 26, and is fast on shaft 98. Speed reduction mechanism 99, is provided in the form of the sheave 101, driven by shaft 98, and in driving contact with the second roller 91, through a one-way clutch 102, the sheave 101 being of predetermined less diameter than the diameter of roller 81.

Thus, the advance of the apron 26, at a predetermined speed, rotates the roller 81, at that speed which in turn rotates the second roller 91, for example, at one-third speed so that the carriage and push rod hold back and compress the line of flats 41, on the secondary apron, as well as holding the leading flat upstanding on lower edge 27.

The compression of the flats 23 in the line of flats 41, is sometimes necessary when the flats being run on the folder gluer are narrow and elongated such as tooth brush boxes 103, such boxes being advanced along the paper line of the folding and gluing zones while extending longitudinally thereof, as shown diagrammatically in FIG. 7. When such flats 103, reach the stacker they must be turned by a turning plow 104, to extend laterally and transversely of the stacker apron as at 105, in order to be shingled in a manageable manner for handling and packing. Having been so turned by the edge stacker, or plow, 104, the resulting line of flats is loosely packed and a slug to fit a case would be incapable of grasp by an operator as too long.

It is for that reason that the apparatus and method of the invention includes the step of slowing down the advance of the flats relative to the speed of the apron to compress the line of flats into manageable, slugs, easily handled by an operator as a bodily, transportable, slidable unit.

As shown in FIG. 8 the preferred form of hold down belt 33 is at least one elongated alignment belt 106 trained around sheaves 107, 108 and 109 and having tension control sheaves 113, 114 and 115. Alignment belt 106 includes a lower stretch advancing in the direction of advance of the shingled flats on primary apron 21 with a first portion at a spaced uniform distance above the level of primary apron 21 and a second portion inclining upwardly and forwardly to a level substantially equal to the height of an erected flat upstanding on its lower edge on secondary apron 26. An endless belt 110 trained around sheaves 111 and 112 is also provided with its lower stretch in contact with the upper edges of the shingled flats. The inclined portion of alignment belt 106 raises the upper edges of the shingled flats as the slower running secondary apron 26 slows the advance of the lower edges thereby raising the flats to upstanding, erect position as shown. The belt nip 119 between the primary apron 21 and the secondary apron 26 assists in pivoting the flats upright.

As shown in FIG. 8A, the belt 106 is formed of an inner layer of fabric such as canvas 117 and an outer layer of rubber-like material 118, the outer layer having a plurality of spaced transverse ribs, ridges or knobs to increase the contact with the upper edges of the flats.

FIG. 9 is similar to FIG. 7 except that it shows that a continuous stacker apron 123 can be used with the edge stacker, or plow 104 rather than a primary and secondary apron separated by a nip.

What is claimed is:

1. Count divider apparatus for segregating a counted slug of flats from a plurality of such flats being advanced in a path on the apron of a stacker at a predetermined speed in shingled formation, said apparatus comprising:

an endless elongated, alignment belt, trained around sheaves mounted above said apron, said belt having a lower stretch advancing in the direction of advance of said shingled flats with a first portion extending longitudinally at a spaced uniform distance above said apron and a second portion inclining upwardly and forwardly to a level substantially equal to the height of an erected flat, said lower stretch advancing at greater speed than the speed of said apron and riding on the upper edges of said flats to raise them from shingled to erect position, and a movable wheeled carriage mounted to roll alongside said path, said carriage having a segregation rod mounted to move horizontally in and out of the path of the leading slug of said flats to maintain its erect position and having a one way clutch on a wheel thereof to allow the carriage to advance as fast as the apron but permit free reverse rolling thereof.

2. Apparatus as specified in claim 1 wherein:

the lower stretch of said alignment belt includes a plurality of spaced, transversely extending, ribs or ridges for engaging and lifting up the upper edges of said shingled flats.

3. Apparatus as specified in claim 1 where:

said stacker apron is divided into a primary apron advancing at a predetermined speed under the first portion of said alignment belt and a secondary apron advancing at a lesser speed, under the second portion of said alignment belt, said secondary apron slowing the advance of the lower edges of the shingled flats on said aprons as said alignment belt engages the upper edges thereof and raises said flats from shingled to erect position upstanding substantially vertically on said secondary apron.

4. Count divider apparatus of the type having a plurality of flats advancing along a stacker apron in an elongated zone in which said flats are in shingled formation, close-packed, counted slugs, supported on their lower edges, characterized by:

elongated alignment belt means extending longitudinally above said apron, in a zone in advance of said first mentioned zone, said means including at least one endless belt having a lower stretch advancing in the direction of advance of the flats shingled on said apron and in contact with the upper edges of said flats, said lower stretch having a plurality of spaced transverse ridges thereon, and said lower stretch having an upwardly and forwardly inclined portion for lifting said shingled formation of flats to upstanding, erected position and having means for advancing said belt means at a greater relative speed than the speed of said apron.

* * * * *